US005652968A

United States Patent [19]

Kodaira

[11] Patent Number: 5,652,968

[45] Date of Patent: Aug. 5, 1997

[54] TOILET FIXTURE AUTOMATIC FLUSHING DEVICE

[75] Inventor: Makoto Kodaira, Tokyo-to, Japan

[73] Assignee: Uro Denshi Kogyo Kabushiki Kaisha, Tokyo-to, Japan

[21] Appl. No.: 500,146

[22] Filed: Jul. 10, 1995

Related U.S. Application Data

[63] Continuation of Ser. No. 139,182, Oct. 19, 1993, abandoned.

[30] Foreign Application Priority Data

Oct. 19, 1992 [JP] Japan ..... 4-072687 U

[51] Int. Cl.[6] ..... E03D 5/10

[52] U.S. Cl. ..... 4/313

[58] Field of Search ..... 4/302, 304, 305, 4/313

[56] References Cited

U.S. PATENT DOCUMENTS 3,590,397 7/1971 Akamatsu ..... 4/313
5,251,872 10/1993 Kodaira ..... 4/304 X
5,313,673 5/1994 Saadi et al. ..... 4/313
5,455,971 10/1995 Sakakibara et al. ..... 4/313

FOREIGN PATENT DOCUMENTS 0487977 6/1992 European Pat. Off. ..... 4/313
0248541 10/1990 Japan ..... 4/313

*Primary Examiner*—Charles E. Phillips
*Attorney, Agent, or Firm*—Ladas & Parry

[57] ABSTRACT

A toilet fixture automatic flushing device comprising: a sensor means for detecting proximity of a human body, a signal receiving means for receiving externally imparted data, and a control means whereby: after elapse of a first predetermined time, departure of the human body is detected and flushing water is emitted; and said signal received time by said receiving means and a second predetermined time are compared; and if said signal receiving time is shorter, regardless of said sensor detection, flushing water is emitted; and if said signal receiving time exceeds said predetermined time, at a third predetermined time, the flushing water emission is stopped.

4 Claims, 3 Drawing Sheets

A
B
C
112
114
113
116
107
117
TIME
t1 t2 t3 t4 t5 t6 t7 t8 t9 t10 t11 t12 t13 t14 t15
sec

TOILET FIXTURE AUTOMATIC FLUSHING DEVICE

This is a continuation of application Ser. No. 08/139,182 filed on Oct. 19, 1993 now abandoned.

DETAILED DESCRIPTION OF THE INVENTION

1. Industrial Field of the Invention

This invention relates to a device for automatically flushing a toilet fixture.

2. Prior Art

Conventional devices have existed for automatically flushing, for example, a male urinal when a user approaches, uses and departs from the urinal. Many such devices utilize infrared or other sensors for detecting the human body. In other words, the emitted infrared light is reflected by the body of the person in front of the urinal and if the detected infrared light is no longer detected, after a predetermined time, the departure of the user is presumed and flushing water is emitted.

Problems addressed for the invention

The following types of problems are encountered by conventional automatic flushing devices.

A first example is when the urinal is being scrubbed with a cleaning agent. The janitor's body is also detected, and even though cleaning is not complete, after elapse of a predetermined time, user departure is presumed by the device and the cleaning agent is flushed away.

A second example occurs after scrubbing the urinal. In order to intentionally flush the cleaning agent, the flushing water will not flow unless the janitor stands in front of the urinal until the predetermined time elapses.

Although it is conceivable to provide a covered switch or other means for changing the operating status of the automatic flushing device during cleaning, in view of such aspects as work efficiency, the need to perform this type of task for cleaning each fixture is undesirable.

SUMMARY OF THE INVENTION

An object of the present invention is to provide an automatic flushing device in which the flushing water emission can be stopped according to a manual operation, or the flushing water can be intentionally emitted.

Means for resolving the problems

To achieve the abovementioned object, an automatic toilet fixture flushing device in accordance with the present invention in normal operating mode functions so that when a user has approached and after a first predetermined time has elapsed, departure is detected using a sensor and flushing water is emitted, and comprises a signal receiving means for receiving externally imparted data, and a control means whereby said signal receiving time by said signal receiving stage and a second predetermined time are compared. If said signal receiving time is shorter, flushing water is emitted regardless of said sensor detection, but if said signal receiving time exceeds said second predetermined time, flushing water is stopped for a third predetermined time.

Operation

When external data are received by the signal receiving means, the received signal and the second predetermined time are compared by the control means. If the signal receiving time is shorter, flushing water is emitted regardless of the sensor detection, but if the signal receiving time exceeds the second predetermined time, flushing water is stopped for a third predetermined time. This invention enables emitting or stopping the flushing water according to requirements and regardless of human body detection by merely applying external data.

PREFERRED EMBODIMENT

Following is a description of a preferred embodiment of this invention with reference to the attached drawings.

Figure 2:
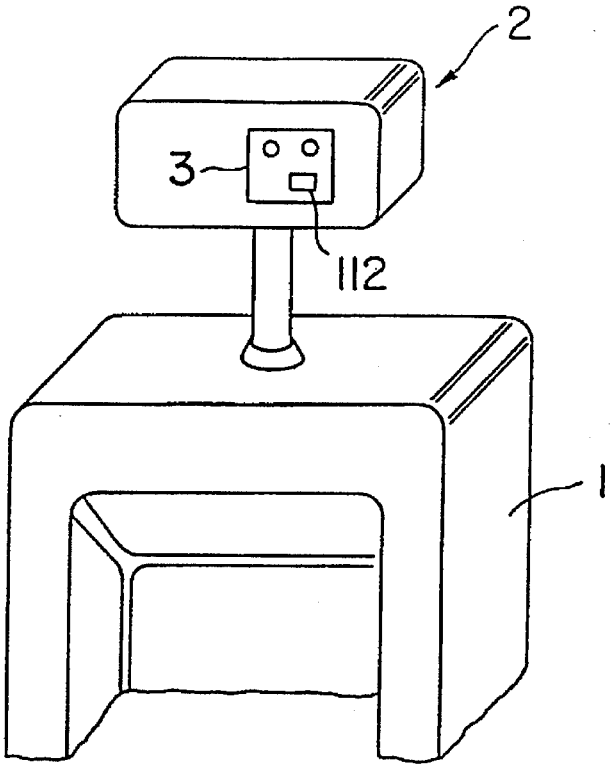
FIG. 2 shows an external inclined view of a male urinal automatic flushing device in accordance with a preferred embodiment of this invention.

The external appearance of an automatic flushing device for a male urinal in accordance with this embodiment is shown in FIG. 2. The automatic flushing device 2 is installed at the top of the male urinal 1. A control circuit section 3 is provided on the front of the automatic flushing device 2 for detecting a human body. The control circuit section 3 contains a reed switch, described later herein.

Figure 3:
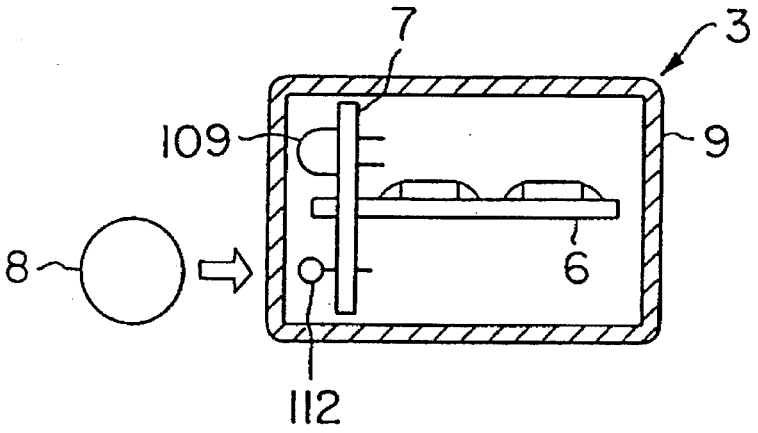
FIG. 3 shows an abbreviated cross sectional view of a sensor section for a male urinal automatic flushing device in accordance with a preferred embodiment of this invention.

FIG. 3 shows a cross sectional view of the control circuit section 3 from, for example, the right side. Inside the case 9 of the control circuit section 3 are the control circuit components mounted on printed wiring boards 6 and 7, an infrared light emitting diode 109, a reed switch 112 and other parts. The contacts of this reed switch 112 are normally open and close when a magnet 8 is brought into proximity with the exterior of the case 9.

Figure 1:
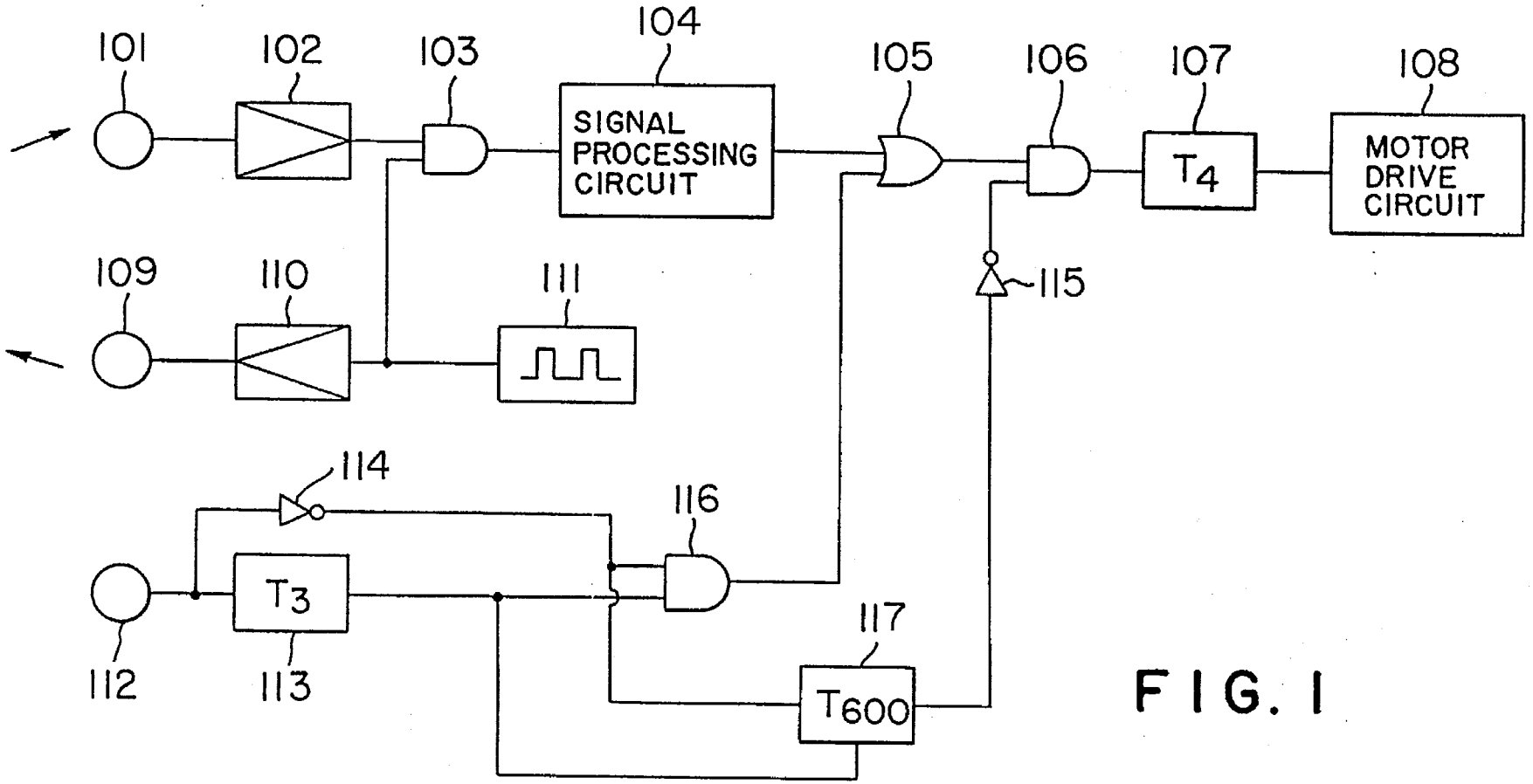
FIG. 1 shows a block diagram of circuit composition for a toilet fixture automatic flushing device in accordance with a preferred embodiment of this invention.

A circuit composition of an automatic flushing device in accordance with this embodiment is shown in FIG. 1. A pulse oscillator 111 generates a pulse signal for regulating the timing of the infrared light emission. A current amplifier circuit 110 amplifies the pulse signal generated by the pulse oscillator 111. The amplified pulse signal from the current amplifier circuit 110 is applied to the infrared light emitting diode 109. In accordance with this pulse timing, the infrared light emitting diode 109 emits infrared light in pulse form.

An infrared light detecting phototransistor 101 detects infrared light reflection from a human body of infrared light emitted from the infrared light emitting diode 109. A second current amplifier circuit 102 amplifies the output signal from the infrared light detecting phototransistor 101 and applies it to an AND circuit 103. The outputs of the current amplifier circuit 102 and pulse oscillator 111 are applied to the AND circuit 103. Consequently, the AND circuit 103 produces a High level signal output only when infrared light reflection from a human body is detected while the pulse signal output is produced from the pulse oscillator 111. This allows removing noise components other than infrared light emitted by the infrared light emitting diode 109 and reflected from the human body.

A signal processor circuit 104 count the pulse signal output from the AND circuit 103. When this count continues for a predetermined number and afterwards ceases for even one count, the user departure is interpreted and a signal is produced for emitting the flushing water. This predetermined count is set for a suitable time in order to exclude cases of persons passing in front of the urinal without using it.

The output signal from the signal processor circuit 104 is applied via an OR circuit 105 and an AND circuit 106 to an output time determining timer 107. Here, the signals from the OR circuit 105 and AND circuit 106 are respectively applied to an AND circuit 116 and an inverter 111, described below. But in normal operation, the OR circuit 105 output is Low level and the AND circuit 106 output is High level.

When the High level signal from the AND circuit 106 is applied to the output time determining timer 107, the flushing signal output is produced for a fixed period of time, for example 4 seconds, required for flushing water emission. While this flushing signal is applied to a motor drive circuit 108, a motor (not shown in the drawing) is driven for emitting the flushing water.

By the above circuit operation, when a human body has approached, after elapse of a predetermined time, departure is interpreted and flushing is performed automatically.

In this embodiment, in addition to the flushing of normal mode operation, according to requirements, means are provided so that flushing water does not flow for a predetermined time, and for intentionally producing flushing water flow at a desired time. These type operations are performed regardless of human body detection and moreover without need for such procedures as opening the cover and changing the circuit internal connections.

The reed switch 112 contacts are normally open and a Low level signal output is produced. As indicated in FIG. 3, when a magnet 8 is moved in the direction shown by the arrow and brought into proximity with the reed switch 112 its externally imparted magnetic field, i.e. data, closes the contacts and a High level output is produced. Conversely, when the magnet 8 is withdrawn from the reed switch 112, the reed switch 112 produces a Low level signal output.

Figures 4A, 4B, 4C, 4D, 4E, 4F:
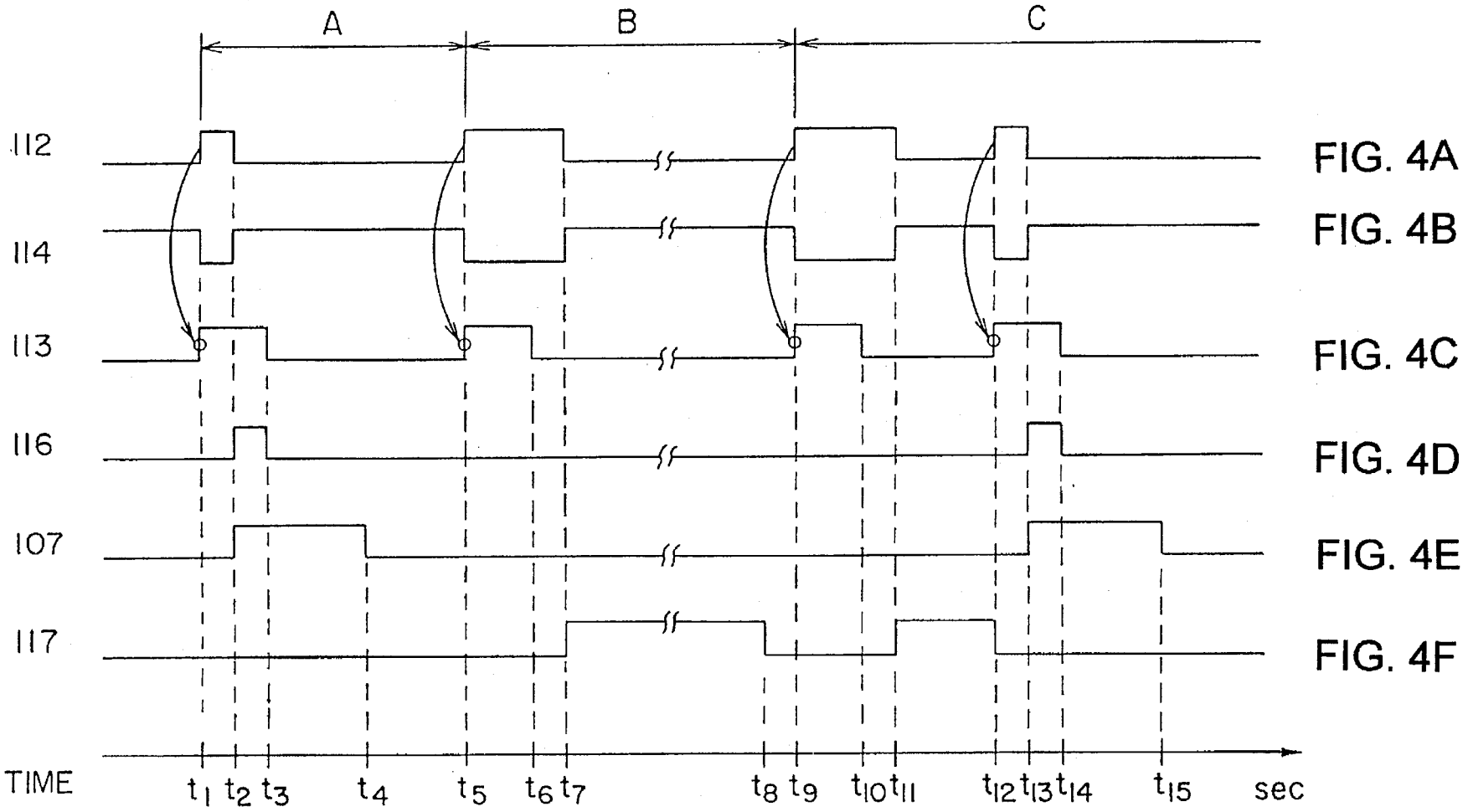
FIG. 4 shows a timing chart for the essential output waveforms of a male urinal automatic flushing device in accordance with a preferred embodiment of this invention.

According to the continuous length of time the High level signal output is produced from the reed switch 112, flushing water emission is stopped or intentionally produced. The operations in this case are described below with reference to the signal timing chart of FIG. 4.

Case A corresponds to the case when the High level signal output from the reed switch 112 is shorter than the predetermined time of, for example, 3 seconds. At time point t1, the reed switch 112 detects a close magnet and produces a High level output signal. Less than 3 seconds later, at the time point t2, the magnet separation is detected and a Low level output signal is produced. The signal from this reed switch 112 is applied to a timer 113 and an inverter 114. When the timer 113 is triggered by the signal from the reed switch 112, a High level output is produced until time t3 when 3 seconds have elapsed. The inverter 114 inverts the signal from the reed switch 112.

The timer 113 and inverter 114 inputs are applied to an AND circuit 116. While both these inputs are High level, i.e., until time point t3 from the time point t2 when the inverter 114 output signal rises from Low level to High level and the timer 113 produces a continuous High level output signal, the AND circuit 116 produces a High level signal output.

When the AND circuit 116 produces a High level signal output, regardless of detection by the infrared detecting phototransistor 101, the High level signal from the OR circuit 105 is sent to the AND circuit 106.

The timer 117 is triggered at the time point t2 when the signal from the inverter 114 rises from Low level to High level, and produces a High level signal output over a period of, for example, 10 minutes. However, it is reset during the High level signal output from the timer 113, i.e., for 3 seconds. Consequently, in case A where the magnet 8 proximity detection is less than 3 seconds, the output from the timer 117 remains at Low level. This Low level output from the timer 117 is inverted by the inverter 115 and applied to the AND circuit 106.

Consequently, a High level signal output is produced from the AND circuit 106 between time point t2, while a High level signal output is produced from the AND circuit 116, and the time point t3. By the signal rise to High level at this time point t2, the output time determining timer 107 is triggered, and a High level flushing signal output is produced until the time point t4. As a result, the motor drive circuit 108 drives the motor and flushing water is emitted.

Case B is when the magnet 8 proximity is detected for more than 3 seconds from time point t5 to time point t6, and a High level signal output is produced from the reed switch 112. In this case, after the 3 second High level signal output from the timer 113 until time point t6 and further until time point t7, a Low level signal is produced from the inverter 114. For this reason, of the inputs from the inverter 114 and the timer 113 to the AND circuit 116, one is always at Low level, and the AND circuit 116 output is always Low level. Consequently, in the same manner as normal mode operation, a Low level output signal is sent from the AND circuit 116 to the OR circuit 105.

At time point t7 when the inverter 114 rises from Low level to High level, the timer 117 is triggered. Also, the timer 113 output at time point t6, after 3 seconds have elapsed from time point t5, is already at Low level. For this reason, the timer 117 is not reset by the output from the timer 113 and produces a High level signal output from time point t7. This output continues until time point t8 when 10 minutes have elapsed.

The High level output signal produced from the timer 117 is inverted by the inverter 115 and applied as a Low level signal to the AND circuit 106. By this, the AND circuit 106 output signal is Low level regardless of the output from the OR circuit 105. Consequently, even if infrared light reflected from a human body is detected by the infrared detector phototransistor 101, flushing water is not emitted.

Case C is when the magnet 8 proximity is detected for more than 3 seconds from time point t9 to time point t11, then before 10 minutes have elapsed, the magnet 8 remains in proximity for less than 3 seconds. In the same manner as the above described Case B, the timer 113 produces a High level output from time point t9 until the elapse of 3 seconds at time point t10. The AND circuit 116 output is held at Low level and a Low level signal is applied to the OR circuit 105.

From time point t11 when the inverter 114 output rises from Low to High level, the timer 117 output rises to High level. However, when the magnet 8 proximity is detected between time point t11 to time point t12 (before 10 minutes have elapsed) and time point t13, a High level signal output is produced from the timer 113, and the timer 117 is reset to produce a Low level output. This releases the flushing water stop state.

Afterwards, in the same manner as case A, between time point t13 and time point t14, the outputs of both the timers 114 and 113 are High level, and a High level signal output is produced from the AND circuit 116. This signal is applied via the OR circuit 105 to the AND circuit 106. As mentioned above, since the timer 112 output is Low level from time point t12, a High level signal from the inverter 115 is applied to the AND circuit 106. By this, the flushing signal output from the output time determining timer 107 is applied to the motor drive circuit 108 between time points t14 and t15, and flushing water is emitted.

In the above manner, as results of this embodiment, without regard to human body detection and according to requirements, flushing water emission can be stopped for a fixed period of time, and the flushing water can be emitted intentionally. Moreover, these operations can be performed without need for troublesome procedures such as changing the device internal connections, but by the very simple step of bringing the magnet 8 into proximity to the reed switch 112.

Consequently, for example, when cleaning the urinal as well, by stopping the flushing water emission, the cleaning agent can be prevented from being flushed away during the scrubbing process. In addition, at the time point when cleaning is completed, since the flushing water can be emitted without need to stand in front of the urinal, work efficiency is improved.

The above described embodiment is provided as an illustrative example and does not limit this invention. For example, in this embodiment, the operations of stopping the flushing water without regard to human body detection and intentionally emitting the flushing water are performed by bringing a magnet in proximity with a reed switch. However, these are not limitations and operation by applying external data to the device is adequate. For example, providing an infrared light detecting means and bringing an infrared light emitting means in proximity with the device exterior for applying data is also adequate.

Also, although a flushing water stopping period of 10 minutes is mentioned in this embodiment, the length of time can be freely set according to requirements.

Also, the sensor for detecting a human body in the normal operating mode is not limited to the infrared detector mentioned in this embodiment. For example, using an electromagnetic wave, sound wave or other means for detecting a human body is adequate.

Modifications

The present invention is also applicable to toilet fixtures for flushing them automatically. In addition, the motor drive circuit 108 can be substituted by an electro-magnetic valve a valve having a button which is driven by a motor to flush, or a ball valve which is opened by a motor, etc.

Results of the invention

As described in the foregoing, the toilet fixture automatic flushing device of this invention allows flushing water to be emitted or stopped for a fixed period of time according to requirements by simple operation and regardless of human body detection, thereby improving work efficiency in cleaning and other procedures.

Thus, according to the above description, a control for an automatic flushing device for a toilet fixture has a sensor 101, 109 for detecting proximity of a human body so as to produce a signal to flush water when the sensor detects departure of the human body after elapse of a first predetermined time. Also, a signal receiver 112 receives externally imparted data. A control 104, 106, 107, 113, 114, 116, 117 compares a time period of the receiving of the signal receiver and a second predetermined time so as to flush water regardless of the detection of the sensor when the receiving time period is shorter than the second predetermined time and not flush water for a third predetermined time when the receiving time period is equal to or longer than the second predetermined time.

What is claimed is:

1. A control for an automatic flushing device for a toilet fixture, the device comprising:

sensor means (101, 109) for detecting proximity of a human body so as to produce a signal to flush water when said sensor means detects departure of a human body after elapse of a first predetermined time;

signal receiving means (112) for receiving externally imparted data; and control means (104, 106, 107, 113, 114, 116, 117) for comparing a time period of the receiving of the signal receiving means and a second predetermined time so as to flush water regardless of the detection of the sensor means when the receiving time period is shorter than the second predetermined time and not flush water for a third predetermined time when the receiving time period is equal to or longer than the second predetermined time.

2. The automatic flushing device according to claim 1;

said signal receiving means is constructed as a combination of a magnet and a reed switch.

3. The automatic flushing device according to claim 1, wherein said control means further controls the flushing of the water such that, when the water is not being flushed for the third predetermined time, flushing water is released if the signal receiving means receives the externally imparted data.

4. The automatic flushing device according to claim 1, wherein said control means comprises:

a first timer for outputting a flush-stop signal for a first predetermined period by receiving the output from said signal receiving means;

a second timer for outputting a release signal for a second predetermined period by receiving the output from said signal receiving means so as to reset said first timer during the second predetermined period;

a logic gate for producing a flush signal by receiving both the output of said signal receiving means and the release signal from second timer to detect that the release signal is longer than the output of said signal receiving means; and a third timer for outputting a flushing signal for a third predetermined period after receiving the output of said logic gate without receiving the flush-stop signal from said first timer.

* * * * *